US006648616B2

(12) United States Patent
Patel et al.

(10) Patent No.: US 6,648,616 B2
(45) Date of Patent: Nov. 18, 2003

(54) SEALED COMPRESSOR HOUSING WITH NOISE REDUCTION FEATURES

(75) Inventors: Tapesh Patel, Hotsprings, AR (US); Sudarshan K. Narasipura, Arkadelphia, AR (US); Wei Zhou, Liverpool, NY (US)

(73) Assignee: Scroll Technologies, Arkadelphia, AR (US)

( * ) Notice: Subject to any disclaimer, the term of this patent is extended or adjusted under 35 U.S.C. 154(b) by 28 days.

(21) Appl. No.: 10/037,799

(22) Filed: Jan. 4, 2002

(65) Prior Publication Data

US 2003/0129072 A1 Jul. 10, 2003

(51) Int. Cl.[7] ..... F04B 39/00; F04B 53/00
(52) U.S. Cl. ..... 417/572; 417/410.5; 417/423.14
(58) Field of Search ..... 417/410.5, 423.14, 417/572, 902; 418/55.1

(56) References Cited

U.S. PATENT DOCUMENTS

| | | | | | |
|---|---|---|---|---|---|
| 5,340,292 | A | | 8/1994 | Steele | |
| 5,401,150 | A | | 3/1995 | Brown | |
| 5,487,648 | A | * | 1/1996 | Alfano et al. | 417/312 |
| 5,584,674 | A | | 12/1996 | Mo | |
| 5,588,810 | A | | 12/1996 | DiFlora et al. | |
| 5,605,447 | A | * | 2/1997 | Kim et al. | 417/312 |
| 5,997,258 | A | | 12/1999 | Sawyer, III et al. | |
| 6,035,963 | A | | 3/2000 | Wollitz | |
| 6,280,155 | B1 | * | 8/2001 | Dreiman | 417/410.5 |
| 6,422,833 | B1 | * | 7/2002 | Park | 417/363 |
| 6,494,690 | B2 | * | 12/2002 | Seo | 417/415 |
| 2002/0006342 | A1 | * | 1/2002 | Han | 417/312 |

* cited by examiner

*Primary Examiner*—Cheryl J. Tyler
*Assistant Examiner*—William H. Rodriquez
(74) *Attorney, Agent, or Firm*—Carlson, Gaskey & Olds

(57) ABSTRACT

A sealed compressor assembly includes a compressor pump driven by a motor mounted within a sealed housing. The sealed housing comprises a center shell extending between first and second ends and a lower shell attached to the center shell. The lower shell is generally square shaped with mounting feet extending diagonally from each corner. The lower shell includes a predetermined amount of material removed to shift the resonance frequency of the sealed housing outside the operating frequency range of the motor and compressor.

18 Claims, 3 Drawing Sheets

SEALED COMPRESSOR HOUSING WITH NOISE REDUCTION FEATURES

BACKGROUND OF THE INVENTION

This invention relates generally to sealed compressor housing and specifically to a sealed compressor housing including vibration dampening features to reduce audible noise emission.

Refrigerant compressors typically include a compressor pump unit driven by a motor within a sealed housing. In such compressors, refrigerant flows over the motor driving the compressor pump to cool the motor during operation. Therefore, the sealed housing must provide a fluid tight seal. Most housings are constructed from upper and lower shells attached to corresponding ends of a center cylindrical shell. The motor and compressor are secured within the center shell.

A scroll compressor is one common type of compressor used for commercial and residential applications. Scroll compressors operate by trapping refrigerant within compression chambers formed between interfitting scrolls. Each scroll has a generally spiral wrap extending from a base. Typically, one of the scrolls is an orbiting scroll and the other is non-orbiting. The motor drives the orbiting scroll relative to the non-orbiting scroll to progressively reduce the volume of the compression chambers, thereby compressing the refrigerant.

The compressor and motor create undesirable vibrations and noise. Typically, the motor and compressor operate at a constant speed to emit noise within a known operating frequency range. Noise emanating from the motor and compressor resonates within the sealed housing, thereby increasing the magnitude of noise. Many sealed housings are constructed such that a resonance frequency of the sealed housing is within the operating frequency range of the motor and compressor. The configuration and materials used to construct the sealed housing determines the resonant frequency, and when a sealed housing is constructed such that the resonance frequency is within the frequency range of the motor and compressor, the sealed housing amplifies noise emanating from the motor and compressor.

It is known in the art to modify the construction of the sealed housing to minimize the amplification effects of the sealed housing. Typically, such sealed housings include asymmetrically orientated surfaces disposed within the sealed housing that reflect overall sound waves in a manner to prevent subsequent sound waves from building upon each other to increase noise emanating from the sealed compressor. The asymmetrical shape prevents sound waves from reflecting between two facing surfaces of the sealed housing to minimize resonance within the sealed housing. Asymmetrically shaped components for a sealed compressor increase manufacture and assembly costs to outweigh any noise improvements.

For this reason, it is desirable to design a sealed compressor housing with features that minimize the resonance effects of the compressor and motor to reduce noise emission without prohibitively increasing cost and complicating assembly.

SUMMARY OF THE INVENTION

An embodiment of this invention is a sealed compressor housing with features that attenuate resonant effects of the sealed housing to reduce noise emission.

The disclosed sealed compressor of this invention includes a scroll compressor driven by a motor mounted within a sealed housing. The sealed housing includes a center shell section extending between first and second ends and upper and lower shells attached at the first and second ends. The lower shell has a generally square shaped outer periphery with four mounting feet extending diagonally from each of the corners. The lower shell has a predetermined amount of material removed for attenuating vibrations and noise within an operating frequency range of the compressor assembly. The removal of material within the lower shell affects the resonance frequency at which the sealed housing amplifies noise from the motor and the compressor. In one embodiment, material is removed from the skirt width to make it smaller. The width of the skirt relative to the lower shell shifts the resonance frequency of the sealed housing outside the operating frequency range of the motor and compressor. Adjustment of the resonance frequency of the lower shell reduces overall sound emission of the compressor assembly at any frequency, but the greatest noise reduction is obtained for frequencies within the operating range of the motor and compressor. In the first embodiment of the lower shell, a skirt width no more than four and preferably no more than three times the thickness of the sheet material used forming the lower shell. This configuration resulted in a noise reduction of between 3–5 decibels. In this embodiment, the thickness of the lower shell is approximately 3.5 mm and the skirt width 10 mm.

In another embodiment of the lower shell, notches provided in the skirt changes the resonance frequency of the lower shell. The notches in this embodiment are preferably cut from the skirt in a length selected to be of a particular proportion relative to the total width of the lower shell. In one embodiment, the notch includes radial cutouts at each end, and the notches are positioned symmetrically on each of the four sides of the lower shell.

In another embodiment of the lower shell, the notches are also arranged on each of the four sides of the lower shell, but are instead arranged asymmetrically about the perimeter of the lower shell. The asymmetric arrangement of the notches increases the magnitude of the resonance frequency required to excite the sealed housing, further attenuating audible noise emitted from the sealed housing.

In still another embodiment of the lower shell, a cutout disposed on the top surface changes the resonance frequency of the sealed housing. In this embodiment, the dampening opening is disposed at each corner of the lower shell near each of the mounting feet.

The noise attenuating features of the lower shell disclosed in the various embodiments of this invention change the rigidity of the lower shell to shift the resonance frequency of the sealed housing away from the frequency at which the motor and compressor operate to reduce audible emissions from the sealed compressor. The reduction of audible emissions is accomplished by the adjustment of features on the lower shell at a low cost and without additional assembly steps.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
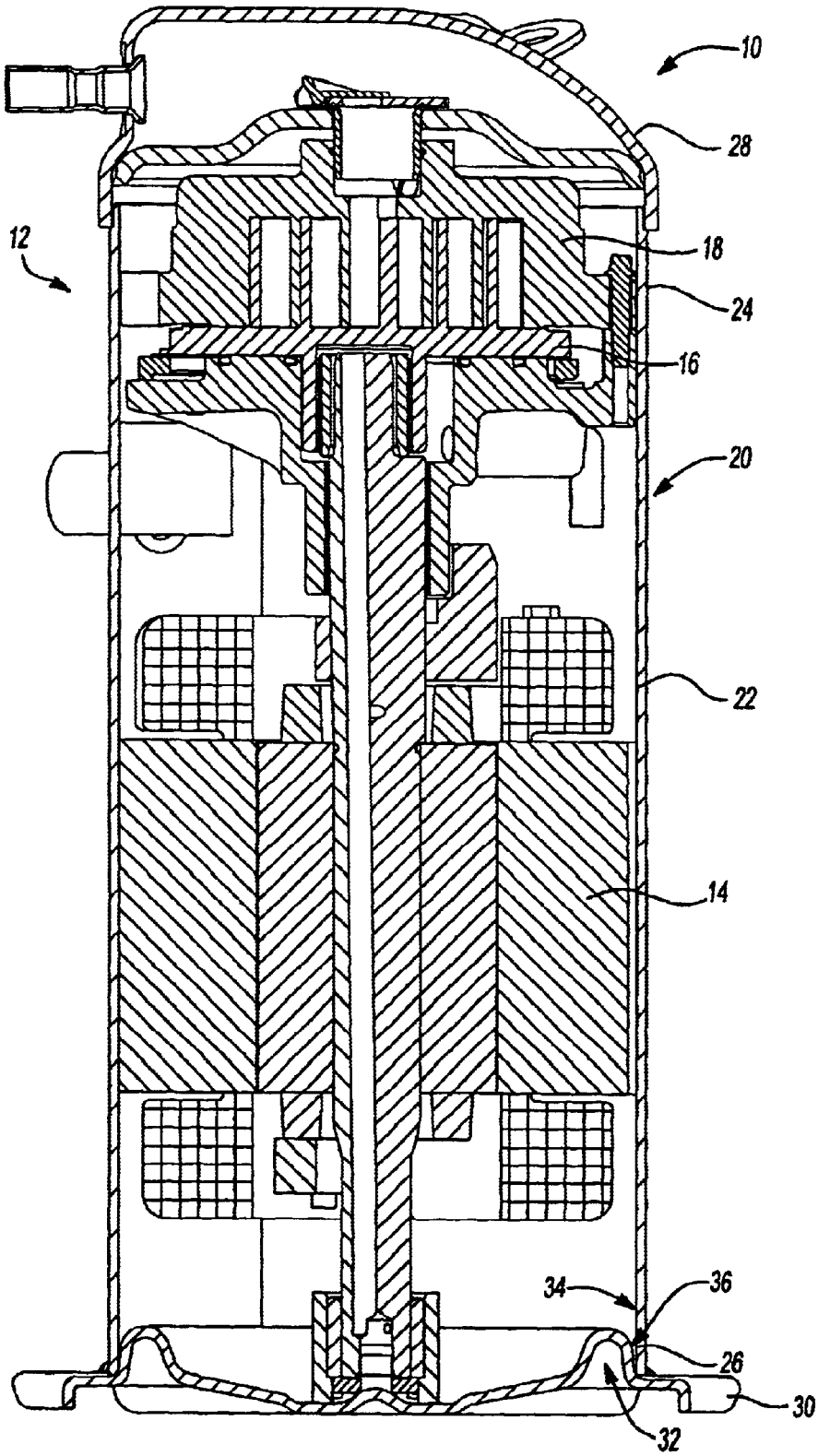
FIG. 1 is a cross-sectional view of a sealed compressor housing.

Referring to the Figures, wherein like numerals indicate like or corresponding parts throughout the several views, a sealed compressor assembly is generally indicated at 10 in FIG. 1. The assembly 10 includes a compressor 12 driven by a motor 14. The compressor 12 illustrated in FIG. 1 is a scroll compressor that includes an orbiting scroll 16 and a non-orbiting scroll 18. Although a scroll compressor is shown, any type of compressor 12 can benefit from the application of this invention.

The compressor 12 and motor 14 are mounted within a sealed compressor housing 20. The sealed compressor housing 20 is fabricated from a first or center shell section 22 extending between first and second ends 24, 26. Attached to the first end 24 of the center shell 22 is an upper shell 28. A second or lower shell section 30 is attached adjacent the second end 26 of the center shell 22. Preferably, the upper and lower shells 28, 30 are welded to the center shell 22 to complete the sealed housing 20. Preferably, the center shell 22 is generally cylindrical in shape, although other shapes would be within the scope of this invention. The lower shell 30 includes a guide section 32 to align the center shell 22 over the lower shell 30. Preferably, the guide section 32 has a u-shaped cross-section and an inner diameter 34 of the center shell 22 aligns with the outer diameter 36 of the guide section 32.

Figure 2:
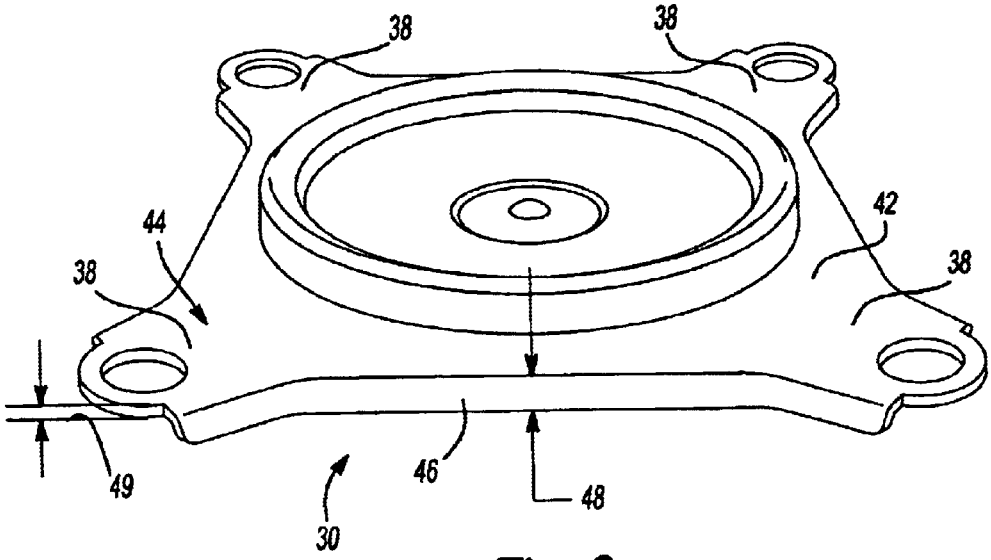
FIG. 2 is an embodiment of the lower shell of this invention.

Referring to FIG. 2, the lower shell 30 includes a skirt 46 disposed about a perimeter. The skirt 46 is disposed at an angle to extend downwardly from a top surface 44. A width 48 of the skirt is relative to the thickness of the material 49 determines the rigidity of the lower shell 30.

In one embodiment, the width 48 of the skirt is no more than four and preferably no more than three times the thickness of the material 49 forming the lower shell 30. Preferably, the lower shell 30 is generally square shaped with a center section 42 and mounting feet 38 extending from each corner. Each of the mounting feet 38 includes a mounting opening 40. The square section 42 and the mounting feet share a common top surface 44.

Figure 3:
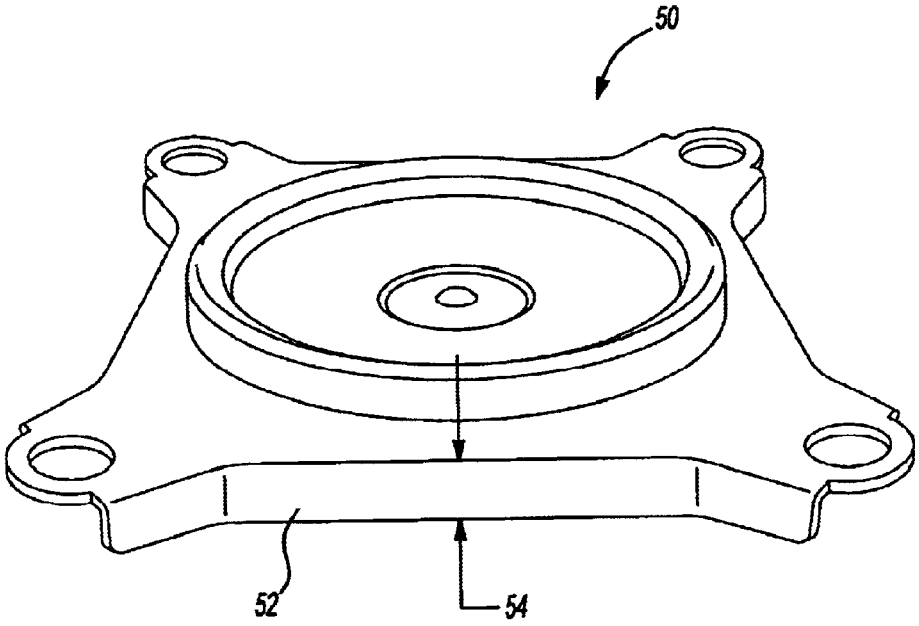
Fig-3 PRIOR ART
FIG. 3 is a perspective view of perspective view of a prior art lower shell.

Referring to the prior art FIG. 3, the prior art lower shell 50 includes a skirt 52 having a width 54 that is greater than the width 48 of the lower shell 30. The width 54 of the prior art lower shell 50 in one embodiment was 16 mm. Referring to FIG. 2, in one embodiment, the skirt 46 is 10 mm wide. The thickness of material 49 of the lower shell 30 in both cases was approximately 3.5 mm. Reduction of the skirt width from 16 mm in the prior art, to no more than four times the thickness of the lower shell resulted in a 3–5 decibel (dBA) reduction in noise emission. The specific dimensions are provided by way of example to illustrate the invention. A worker skilled in the art would understand that the specific dimensions are application specific and that different skirt widths would be required for other lower shell thicknesses and would fall within the scope of this invention.

Figure 4:
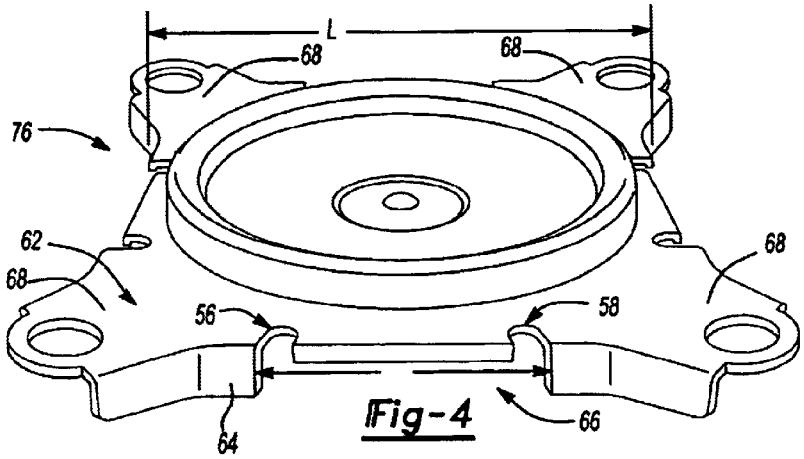
FIG. 4 is a perspective view of another embodiment of the lower shell

Referring to FIG. 4, another embodiment of the lower shell is generally indicated at 76 and includes a top surface 62 and a skirt 64 disposed at an angle to the top surface 62. In this embodiment, the skirt 64 defines a notch 66 disposed between mounting feet 68. The notch 66 changes the resonance frequency at which the sealed housing 20 resonates. The lower shell has a lateral dimension L between the skirts 64. The notch 66 includes a length 56 that is preferably between one fourth and one half the total length L of the lower shell. The width 56 of the notch 66 is adjusted to shift the resonance frequency of the sealed housing 20 to be outside the operating frequency range of the motor 14 and compressor 12. Preferably, opposite ends of the notch 66 includes radial cutouts 58. The radial cutouts 58 include material removed from the top surface 62.

Each of the notches 66 are symmetrically located about the perimeter of the lower shell 76. That is each notch 66 is located in the same location along the skirt 64 such that the notches are symmetrical about the perimeter of the lower shell 76. Such a configuration is only one way of positioning the notches 66. The symmetrically positioned notches 66 reduce the rigidity of the lower shell 76 to change the resonance frequency of the sealed housing 20 to be outside the operational frequency range of the motor 14 and compressor 12.

Figure 5:
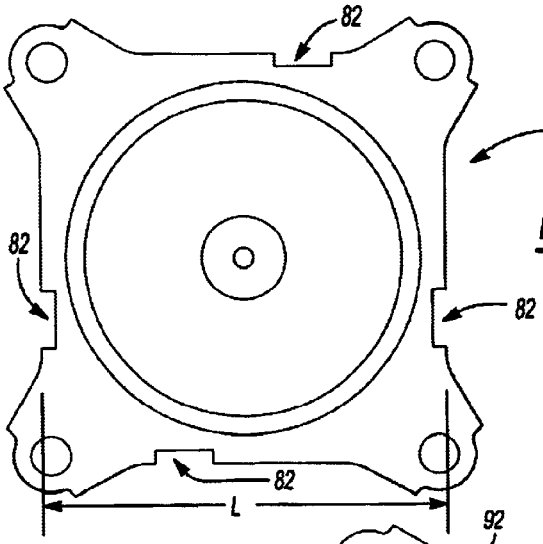
FIG. 5 is a plan view of another embodiment of the lower shell.

Referring to FIG. 5, another embodiment of the lower shell is generally indicated at 80 and includes notches 82 arranged asymmetrically about the perimeter 84 of the lower shell 80. As in the previous embodiment, the notches 82 include a length 56 that is proportional to the total length L of the lower shell 80. The width of each notch 82 is preferably between one fourth and one half the total length L of the lower shell. Arrangement of notches 82 asymmetrically about the perimeter of the lower shell 80 also reduces audible emission by increasing the magnitude of noise or sound waves required to excite the sealed housing 20. The asymmetrical disposition of the notches 82 further attenuates noise by increasing the magnitude of noise or sound waves emanating from the motor 14 and compressor 12 required to excite the sealed housing 20. Increasing the magnitude required to excite the sealed housing 20 reduces amplification of audible noise resulting in less total noise emission from the compressor assembly 10.

Figure 6:
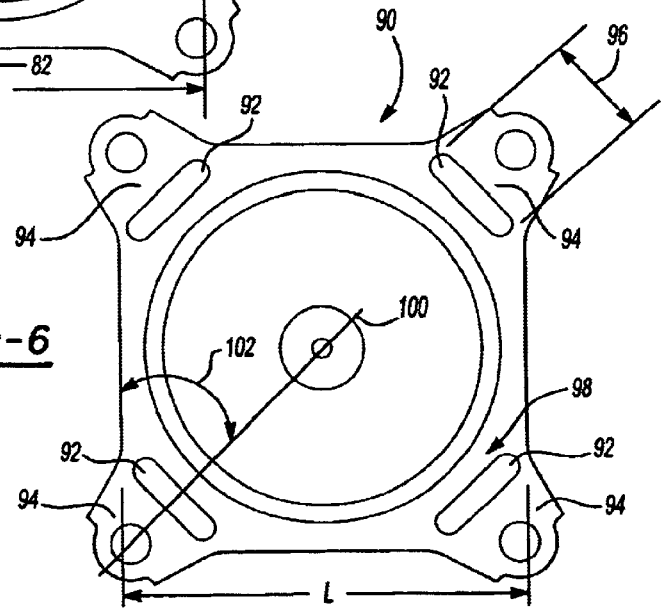
FIG. 6 is a plan view of yet another embodiment of the lower shell.

Referring to FIG. 6, another embodiment of a lower shell is disclosed and is generally indicated at 90. In this embodiment, the lower shell 90 includes at least one cutout 92 to adjust rigidity of the lower shell 90. The cutout 92 changes the rigidity of the lower shell 90 to change the frequency at which the sealed housing 20 will resonate. The cutout 92 is preferably a slot disposed in this top surface 98 and includes a length 96 proportional to the total length L. The length 96 of the cutout 92 is at least one third and preferably one fourth the total length L of the lower shell 80. Although a slot shaped dampening opening 92 is shown, it is within the contemplation of this invention to use cutouts of other shapes.

Mounting feet 94 extend along an axis 100 disposed at an angle 102 relative to a side of the lower shell 90. Preferably, the angle 102 of the axis 100 relative to the side is forty-five degrees. It should be understood that other angles are within the scope of this invention. Preferably, the cutout 92 is positioned such that the length 96 is substantially transverse to axis 100 although it is within the contemplation of this invention to position the cutout 92 at other angles relative to the axis 100. Further, one skilled in the art would understand that position of the cutout 92 is application dependent and it is within the contemplation of this invention to locate the cutout 92 at different locations along the top surface 98.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A sealed compressor assembly comprising:

a compressor pump unit and a motor mounted within a sealed housing;

said sealed housing comprising a first shell section; and a second shell section attached to said first shell section said second shell section including a top surface and at least one skirt extending downward from said top surface, said skirt comprising a width and a cutout disposed within said width for attenuating vibrations and noise within an operating frequency range of said compressor assembly.

2. The assembly of claim 1, wherein said width of said skirt is no more than four times a thickness of the material forming said second shell.

3. The assembly of claim 1, wherein said width of said lower skirt is no more than three times a thickness of said lower second shell.

4. The assembly of claim 1, wherein said second shell includes a perimeter, and said skirt is disposed about said perimeter and includes at least one notch disposed within said skirt width.

5. The assembly of claim 4, wherein said perimeter includes at least one side having a total length, and said notch including a length no more than one half said total length.

6. The assembly of claim 5, wherein said perimeter of said second shell includes at least one side having a total length, and said notch including a length no more than one fourth said total length.

7. The assembly of claim 5, wherein said notches are disposed symmetrically about said perimeter of said second shell.

8. The assembly of claim 5, wherein said notches are disposed asymmetrically about said perimeter of said second shell.

9. A sealed compressor assembly comprising:

a compressor pump unit and a motor mounted within a sealed housing;

said sealed housing comprising a first shell section; and a second shell section formed of sheet material of a thickness, and attached to said first shell section including a top surface and a skirt extending downwardly from said top surface for a width no more than four times said thickness of said second shell.

10. The assembly of claim 9, wherein said width is no more than three times said thickness of said second shell.

11. A sealed compressor assembly comprising:

a compressor pump unit and a motor mounted within a sealed housing;

said sealed housing comprising a first shell section; and a second shell attached to said first shell section and including at least one slot for attenuating vibrations and noise within an operating frequency range of said compressor assembly.

12. The assembly of claim 11, wherein said second shell includes a top surface, and said slot is disposed within said top surface.

13. The assembly of claim 12, wherein said slot includes a length, and said length is no mere than one fourth a total width of said second shell.

14. The assembly of claim 12, wherein said slot includes a length and said length is no more than one half a total width of said second shell.

15. The assembly of claim 12, wherein said second shell is generally square shaped and includes four corners, each of said four corners includes a mounting opening and said slot.

16. A sealed compressor assembly comprising:

a compressor pump unit and a motor mounted within a sealed housing, said sealed housing comprising a first shell section; and a second shell comprising a top surface, a skirt disposed at an angle extending downwardly from said top surface, and a cutout disposed within said skirt.

17. The assembly of claim 16, wherein said second shell includes a total length and said cutout includes a length no more than one half said total length.

18. The assembly of claim 17, wherein said cutout includes a length no more than one fourth said total length.

* * * * *

UNITED STATES PATENT AND TRADEMARK OFFICE

CERTIFICATE OF CORRECTION

PATENT NO. : 6,648,616 B2
DATED : November 18, 2003
INVENTOR(S) : Patel et al.

It is certified that error appears in the above-identified patent and that said Letters Patent is hereby corrected as shown below:

Column 5,
Line 20, please insert -- , -- after "section" and before "said"
Line 32, please delete "lower" before "skirt"
Line 33, please delete "lower" before "second"

Column 6,
Line 26, "mere" should be -- more --

Signed and Sealed this

Ninth Day of March, 2004

JON W. DUDAS
*Acting Director of the United States Patent and Trademark Office*